US010456308B2

(12) United States Patent
Ditor et al.

(10) Patent No.: US 10,456,308 B2
(45) Date of Patent: Oct. 29, 2019

(54) REMOVABLE LEG REST FOR WHEELCHAIRS

(71) Applicants: David Ditor, St. Catherines (CA); Steven John Coates, Aurora (CA)

(72) Inventors: David Ditor, St. Catherines (CA); Steven John Coates, Aurora (CA)

(73) Assignees: David Ditor, St. Catharines (CA); Steven John Coates, Aurora (CA)

( * ) Notice: Subject to any disclaimer, the term of this patent is extended or adjusted under 35 U.S.C. 154(b) by 349 days.

(21) Appl. No.: 14/910,472

(22) PCT Filed: Aug. 7, 2014

(86) PCT No.: PCT/CA2014/050742
§ 371 (c)(1),
(2) Date: Feb. 5, 2016

(87) PCT Pub. No.: WO2015/017935
PCT Pub. Date: Feb. 12, 2015

(65) Prior Publication Data

US 2016/0175175 A1 Jun. 23, 2016

Related U.S. Application Data

(60) Provisional application No. 61/863,347, filed on Aug. 7, 2013.

(51) Int. Cl.
*A61G 5/12* (2006.01)
*A47C 7/50* (2006.01)
(Continued)

(52) U.S. Cl.
CPC ..... *A61G 5/12* (2013.01); *A47C 7/506* (2013.01); *A47C 7/52* (2013.01); *A61G 5/1054* (2016.11); *A61G 5/127* (2016.11); *A61G 5/128* (2016.11)

(58) Field of Classification Search
CPC .. A47C 7/52; A47C 7/506; A61G 5/12; A61G 5/128; A61G 5/1054; A61G 5/127
(Continued)

(56) References Cited

U.S. PATENT DOCUMENTS 5,033,793 A * 7/1991 Quintile ..... A61G 5/12 297/423.33
5,328,247 A 7/1994 Lovins
(Continued)

FOREIGN PATENT DOCUMENTS

EP 1510193 3/2005

*Primary Examiner* — Milton Nelson, Jr.
(74) *Attorney, Agent, or Firm* — Bereskin & Parr LLP/S.E.N.C.R.L., S.R.L.

(57) ABSTRACT

Disclosed herein is a removable leg rest for a wheelchair. The removable leg rest includes a base member configured to be mounted to a wheelchair frame having a wheelchair frame member. The removable leg rest also includes a leg support member pivotally coupled to the base member, and an actuator for pivoting the leg support member relative to the base member between a lowered position and a raised position. One or more mounting clips are used for attaching the base member to the wheelchair frame member. The mounting clips are configured to releasably engage a cross-sectional portion of the wheelchair frame member.

27 Claims, 12 Drawing Sheets

(51) Int. Cl.
*A47C 7/52* (2006.01)
*A61G 5/10* (2006.01)

(58) Field of Classification Search
USPC ..... 297/423.4, 423.26, DIG. 4; 280/304.1, 280/291
See application file for complete search history.

(56) References Cited

U.S. PATENT DOCUMENTS

| | | | | |
|---|---|---|---|---|
| 5,378,041 | A * | 1/1995 | Lee | A61G 5/1067 280/250.1 |
| 6,273,443 | B1 | 8/2001 | Fleigle | |
| 6,422,653 | B1 | 7/2002 | Szczepanski et al. | |
| 6,450,581 | B1 | 9/2002 | Koerlin | |
| 6,494,475 | B2 * | 12/2002 | Rossi | A61G 5/12 280/304.1 |
| 6,585,279 | B1 | 7/2003 | Galloway et al. | |
| 6,773,073 | B1 | 8/2004 | Escobedo | |
| 6,880,845 | B1 * | 4/2005 | Broyles | A61G 5/12 280/250.1 |
| 7,922,187 | B2 | 4/2011 | Fremgen | |
| 8,403,420 | B2 * | 3/2013 | Billescas | A61G 5/128 280/250.1 |
| 10,016,323 | B2 * | 7/2018 | Hall | A61G 5/127 |
| 2004/0075327 | A1 | 4/2004 | Adams | |
| 2006/0012148 | A1 * | 1/2006 | Melgarejo | A61G 5/12 280/304.1 |
| 2011/0062740 | A1 | 3/2011 | Billescas | |

* cited by examiner

REMOVABLE LEG REST FOR WHEELCHAIRS

RELATED APPLICATIONS

This application is a National Stage (371) of International Application No. PCT/CA2014/050742 filed Aug. 7, 2014, which claims the benefit of U.S. Provisional Patent Application Ser. No. 61/863,347 filed on Aug. 7, 2013, and entitled "REMOVABLE LEG REST FOR WHEELCHAIRS", the entire contents of which are all hereby incorporated by reference herein for all purposes.

TECHNICAL FIELD

The embodiments disclosed herein relate to leg rests for wheelchairs, and in particular, to leg rests for reducing or preventing muscle contractures.

INTRODUCTION

The following paragraphs are not an admission that anything discussed in them is prior art or part of the knowledge of persons skilled in the art.

Prolonged wheelchair use can lead to chronic shortening of hamstring muscles (also known as a muscle contracture). This can reduce or limit range of motion of a person's leg at the knee joint, which can impede performance of daily activities and can also make it difficult to transfer the person to or from the wheelchair. Accordingly, chronic muscle contracture can limit independence and can result in costly expenses for attendant medical care. For these reasons, it can be desirable to reduce or prevent muscle contracture in wheelchair users.

Some devices are known for reducing or preventing muscle contracture. For example, U.S. Pat. No. 7,922,187 (Fremgen) describes an atrophy-reducing wheelchair that includes a movable foot support mounted to a linkage that is movably connected to the wheelchair frame. As the wheelchair moves in normal operation, rotation of a wheelchair wheel drives the linkage to provide substantially linear vertical reciprocation of the foot support. According to Fremgen, this gentle and substantially linear vertical motion is expected to provide superior results for maintenance of a wheelchair user's leg muscle mass thus reducing atrophy of the wheelchair user's legs. Additionally, Fremgen suggests that gentle continuous motion of the foot support is expected to aid in maintaining elasticity of the wheelchair user's leg joint ligaments' thus reducing contractures.

One problem with Fremgen is that it requires a specialized wheelchair. This may present a number of issues for patients such as cost, comfort, and customizability.

In view of the above, the embodiments disclosed herein are directed toward a removable leg rest for a wheelchair that is capable of reducing, preventing, or possibly reversing muscle contractures.

SUMMARY

According to some embodiments, there is a removable leg rest for a wheelchair. The removable leg rest includes a base member configured to be mounted to a wheelchair frame having a wheelchair frame member; a leg support member pivotally coupled to the base member; an actuator for pivoting the leg support member relative to the base member between a lowered position and a raised position; and a mounting clip for attaching the base member to the wheelchair frame member, the mounting clip being configured to releasably engage a cross-sectional portion of the wheelchair frame member.

The mounting clip may be configured to circumscribe the cross-sectional portion of the wheelchair frame member.

The mounting clip may include a plurality of mounting clips. For example, the plurality of mounting clips may include a first clip configured to engage a first cross-sectional portion of the wheelchair frame member; and a second clip configured to engage a second cross-sectional portion of the wheelchair frame member.

The first clip may be configured to engage the first cross-sectional portion of the wheelchair frame member along a first axis, and the second clip may be configured to engage the second cross-sectional portion of the wheelchair frame along a second axis that is transverse to the first axis. Each clip may include a connector for pivotally or rotatably attaching the clip to the base member so as to allow an adjustable orientation for the clip.

The second clip may be adjustably coupled to the base member for adjusting relative distance between the first clip and the second clip. For example, the base member may include a positioning rod, and the second clip may be moveably attached to the positioning rod for adjusting the relative distance between the first clip and the second clip.

The mounting clip may be a split-block for clamping onto the cross-sectional portion of the wheelchair frame member. The split-block may include a first portion coupled to the base member, a second portion separable from the first portion, and a fastener for securing the first portion to the second portion and clamping the cross-sectional portion of the wheelchair frame member therebetween.

The mounting clip may be a C-shaped clip having resiliently deflectable arms for engaging the cross-sectional portion of the wheelchair frame member.

The actuator may be motorized. For example, the actuator may include: a stationary flange coupled to the base member; a mobile flange coupled to the leg support member; and a motor for pivoting the mobile flange relative to the stationary flange.

The actuator may also include a battery for powering the motor.

The actuator may also include an angle adjustment switch. The angle adjustment switch may be a rocker-type switch that is spring loaded to a neutral position.

The actuator may include a manually operated ratchet mechanism.

The actuator may include a locking device for holding the leg support member in a selected angular position.

The actuator may include a stop for preventing pivotal movement of the leg support member beyond a maximum raised position. The maximum raised position may correspond to an angle of about 175-degrees.

The actuator may be configured to provide a range of motion between about 85-degrees and about 175-degrees.

The actuator may be configured to pivot the leg support member to a selected angular position that is between about 85-degrees and about 175-degrees.

The leg support member may be configured to support a leg proximal to a heel.

The leg support member may be configured to support a leg along a substantial length thereof.

Other aspects and features will become apparent, to those ordinarily skilled in the art, upon review of the following description of some exemplary embodiments.

BRIEF DESCRIPTION OF THE DRAWINGS

The drawings included herewith are for illustrating various examples of articles, methods, and apparatuses of the present specification. In the drawings.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1:
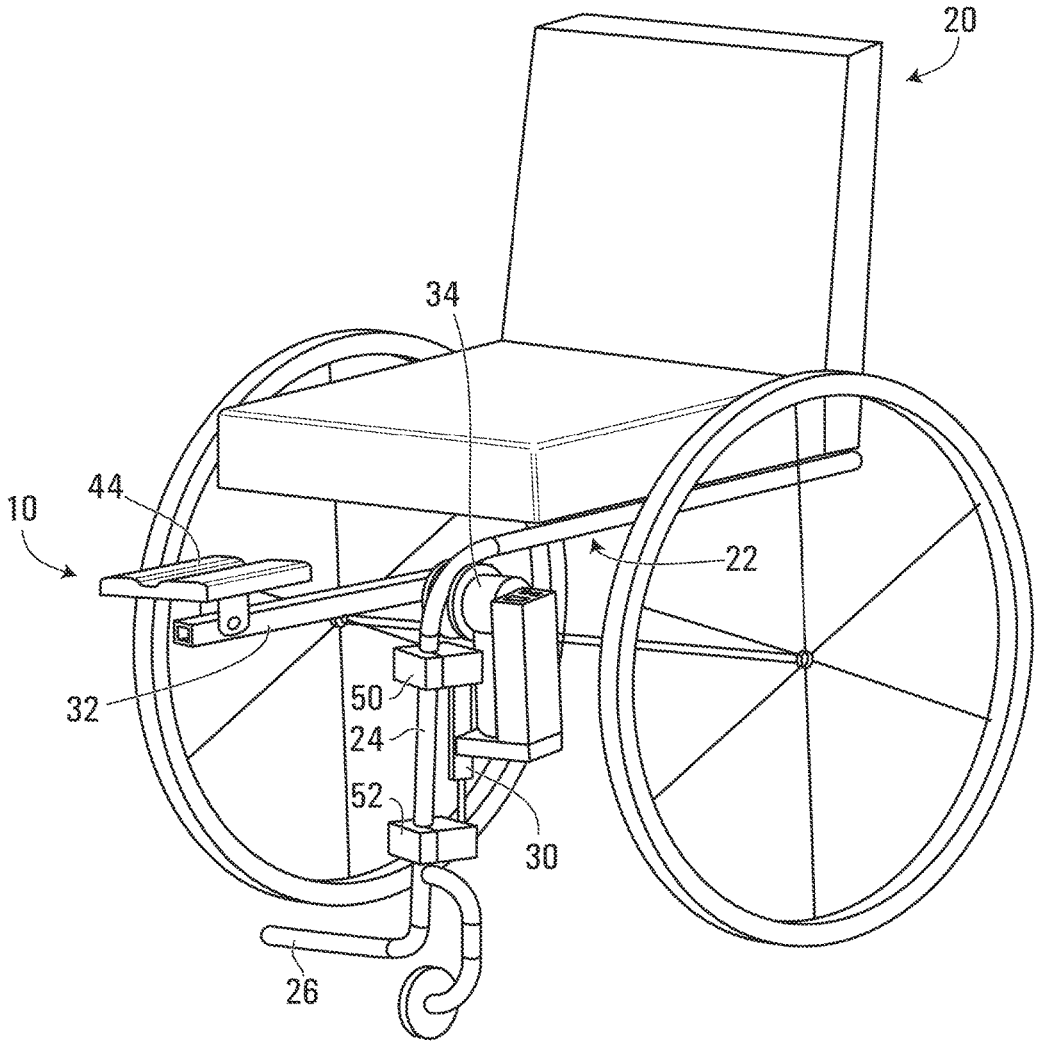
FIG. 1 is a perspective view of a wheelchair with a removable leg rest attached thereto according to one embodiment.
Figure 2:
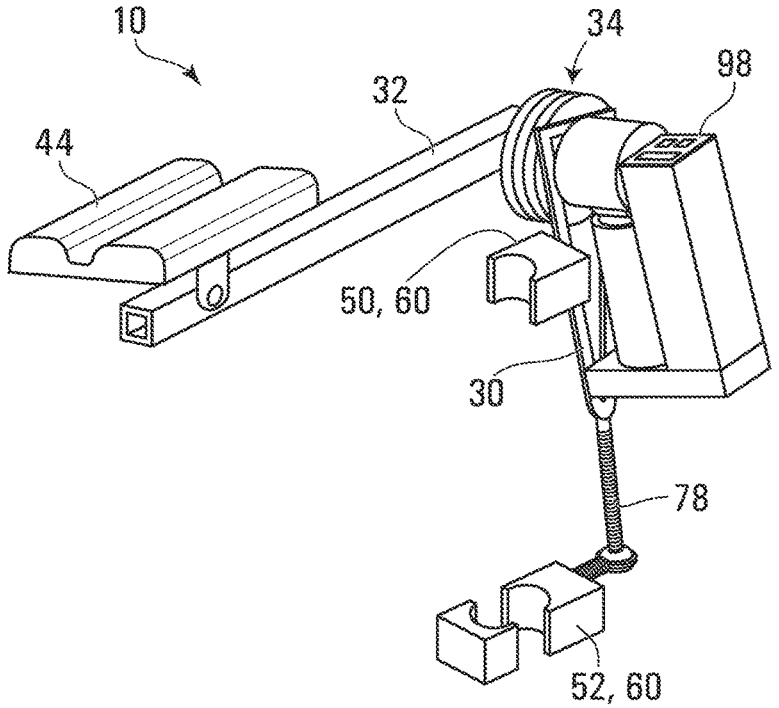
FIG. 2 is a perspective view of the removable leg rest of FIG. 1.
Figure 3:
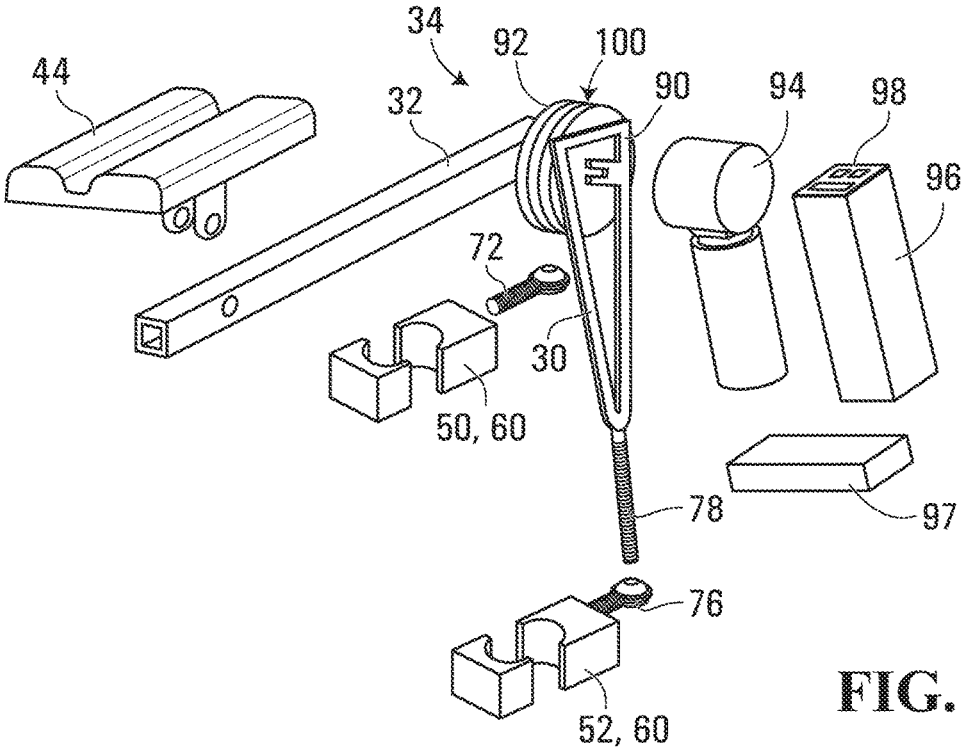
FIG. 3 is a partially exploded perspective view of the removable leg rest of FIG. 1.

Referring to FIGS. 1-3, there is a removable leg rest 10 for a wheelchair 20. The wheelchair 20 includes a wheelchair frame 22 having a front left wheelchair frame member 24 shaped as a circular tube (the front right wheelchair frame member has been omitted for clarity).

As shown, the removable leg rest 10 is mounted to the front left wheelchair frame member 24. In other embodiments, the removable leg rest 10 may be mounted to another portion of the wheelchair frame 22 such as the front right wheelchair frame member. In yet other embodiments, there could be two removable leg rests, each one being mounted to a respective side of the wheelchair 22.

Figures 4A, 4B, 4C, 5:
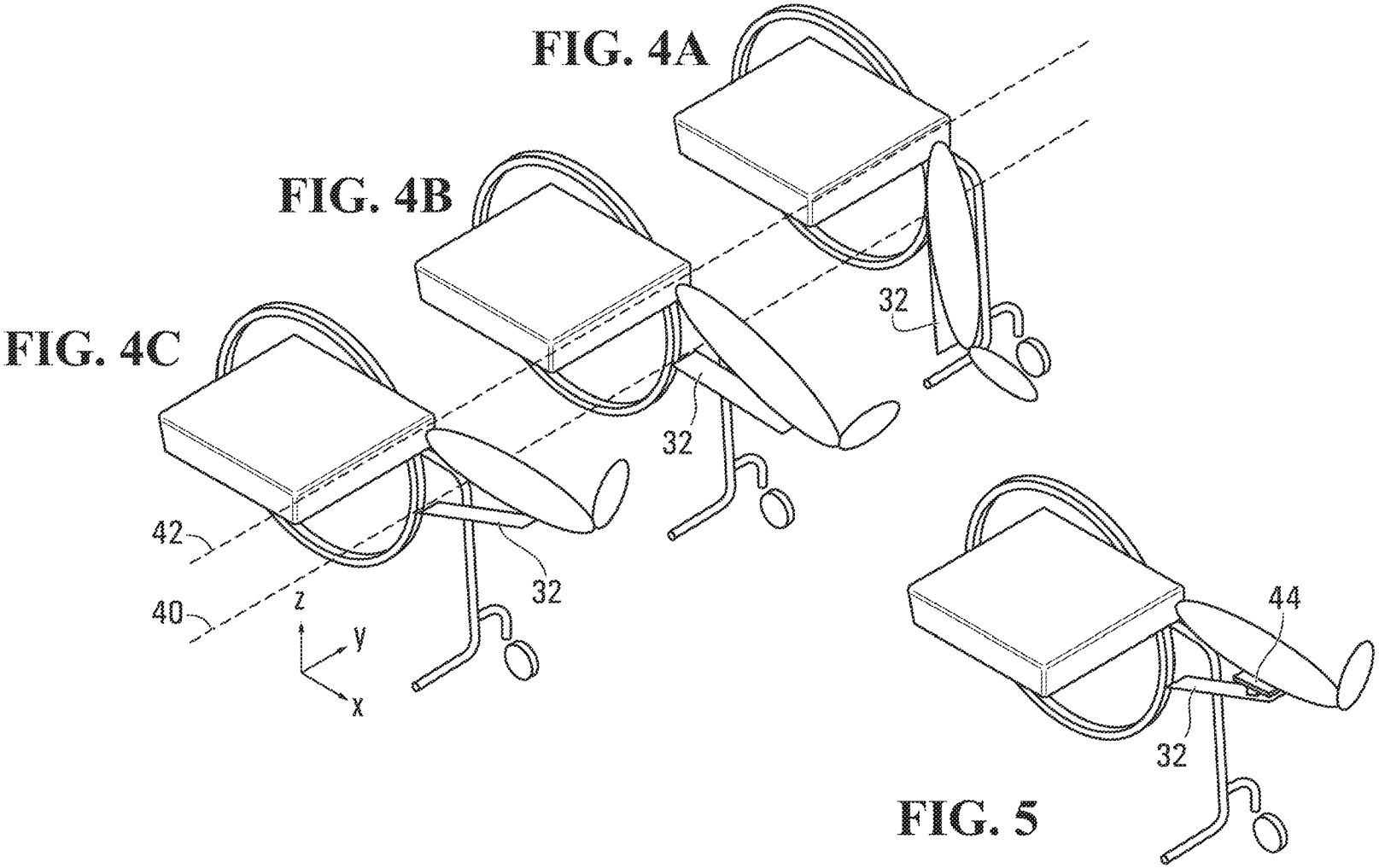
FIGS. 4A, 4B and 4C are perspective views of the removable leg rest having a leg support member pivoted between a lowered position, an intermediate position, and a raised position.
FIG. 5 is a perspective view of the removable leg rest having a contact plate supporting a user's leg proximal to their heel.

The removable leg rest 10 includes a base member 30 configured to be mounted to the wheelchair frame 22, a leg support member 32 pivotally coupled to the base member 30, and an actuator 34 for pivoting the leg support member 32 relative to the base member 30. As shown in FIGS. 4A-4C, the actuator 34 can pivot the leg support member 32 between a lowered position as shown in FIG. 4A, and a raised position as shown in FIG. 4C (also referred to as a "flexed position" and "extended position", respectively). As shown in FIG. 4B, the leg support member 32 can also be pivoted to an intermediate position between the flexed position and extended position. In use, these different positions can stretch a user's leg, which can help to reduce, prevent, or even possibly reverse muscle contractures.

Figure 10:
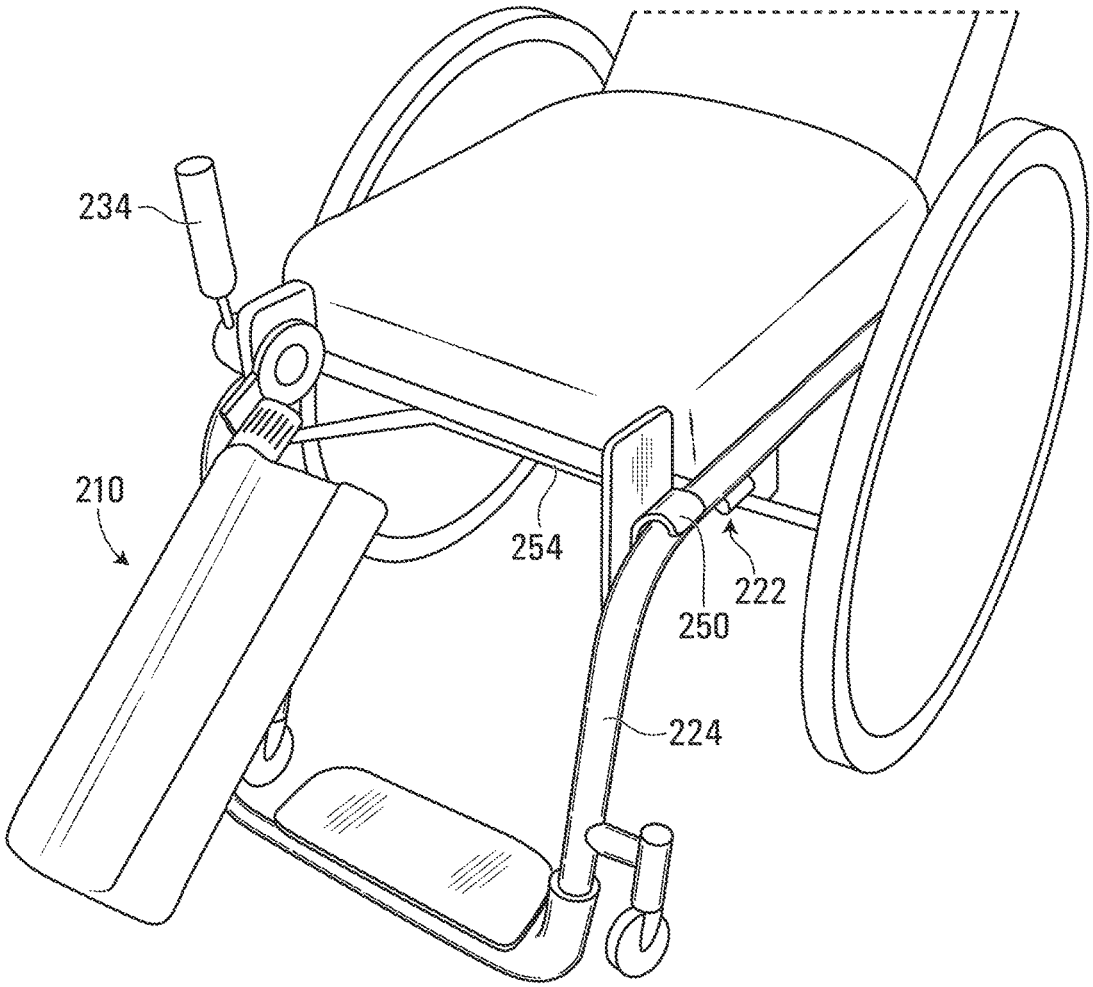
FIG. 10 is a perspective view of another removable leg rest according to another embodiment.

Referring still to FIGS. 4A-4C, the leg support member 32 may pivot about a pivot axis 40 that is offset from a user's knee rotation axis 42. As shown in FIG. 5, the removable leg rest 10 may include a contact plate 44 pivotally coupled the leg support member 32. This can allow for an adjustable contact angle between the user's leg and the leg support member 32, which may help accommodate the offset between the pivot axis 40 and the user's knee rotation axis 42. As shown, the contact plate 44 may be configured to engage the user's leg at or proximal to the user's heel. In other embodiments, the leg support member 32 may be configured to support the user's leg along a substantial length thereof (e.g. as shown in FIG. 10).

Referring again to FIGS. 1-3, the removable leg rest 10 also includes mounting clips 50, 52 for attaching the base member 30 to the wheelchair frame 22. As shown in the illustrated embodiment, there is an upper clip 50 and a lower clip 52. In other embodiments, there may be another number of clips (e.g. one or more clips), and the clips may be configured to engage other portions of the wheelchair frame 22.

Each clip 50, 52 is configured to releasably engage a cross-sectional portion of a wheelchair frame member. For example, as shown, the upper clip 50 engages an upper portion of the front left wheelchair frame member 24, and the lower clip 52 engages a lower portion of the front left wheelchair frame member 24. In other embodiments, the clips 50, 52 may engage other portions of the frame or other frame members.

Figures 6, 7:
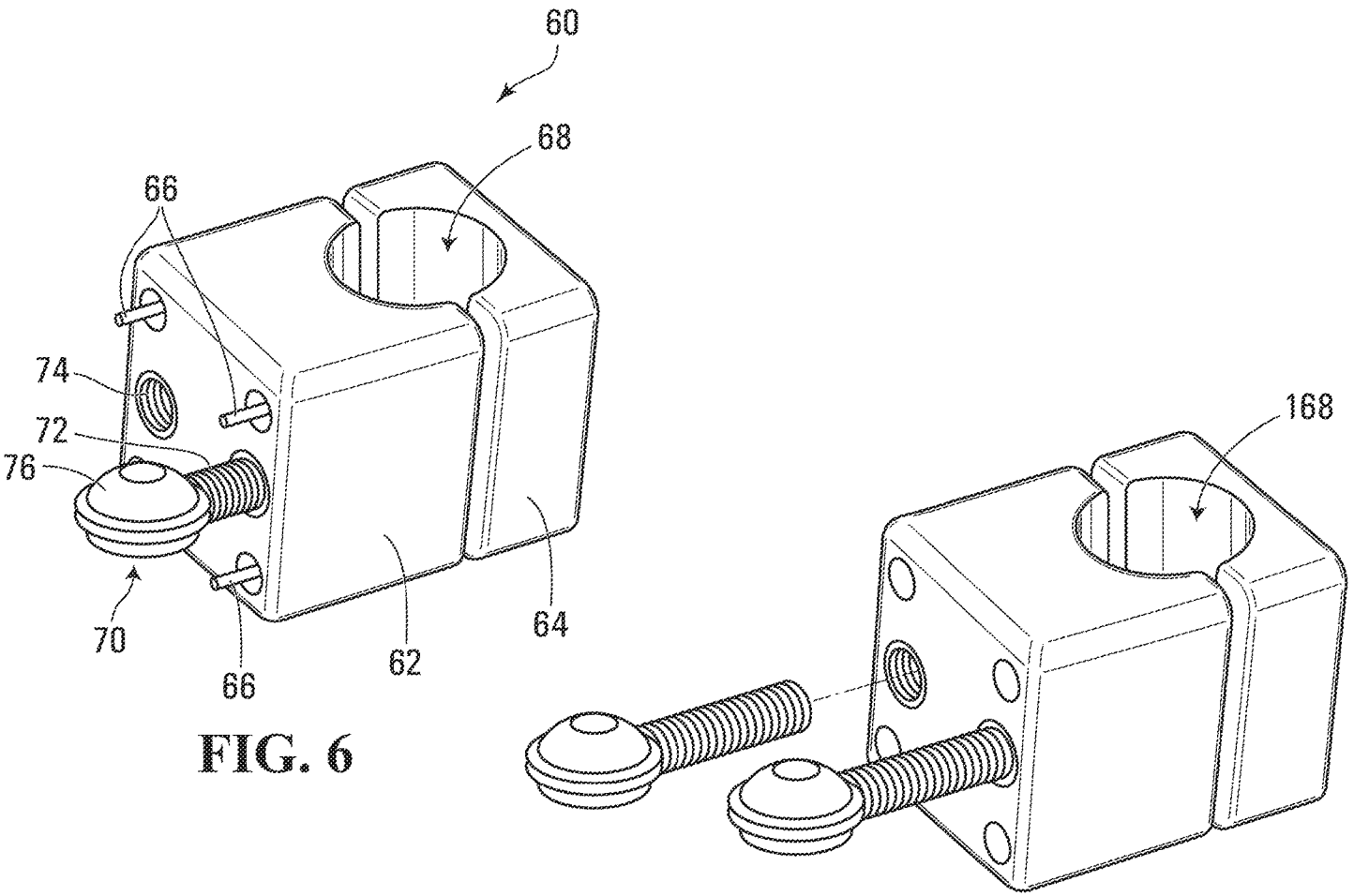
FIG. 6 is a perspective view of a split-block clip for mounting the removable leg rest to the wheelchair.
FIG. 7 is a perspective view of a split-block clip having an oval-shaped opening instead of a circular opening.

In some embodiments, the clips 50, 52 may be configured to circumscribe the cross-sectional portion of the wheelchair frame member 24. For example, in the illustrated example, each clip 50, 52 is a split-block 60 for clamping onto the cross-sectional portion of the wheelchair frame member 24. As shown in FIG. 6, the split-block 60 includes a first portion 62 coupled to the base member 30 (not shown in FIG. 6), and a second portion 64 separable from the first portion 62. The two portions 62, 64 can be attached using quick-release locking pins 66 or other quick-release fasteners such as snap-fittings, buckles, latches, and the like. Quick-release fasteners can make it easier for users to attach or remove the leg rest 10 on their own without help from someone else. In other embodiments, the portions 62, 64 could be attached using other fasteners such as screws or bolts.

Each portion 62, 64 of the split-block 60 may have a groove shaped to engage the wheelchair frame member 24. In the illustrated embodiment, the grooves are semi-circular such that, upon attaching the portions 62, 64 together, the split-block 60 may form a circular opening 68 for engaging the wheelchair frame member 24 therein (which in this case is a circular tube). In other examples, the split-block 60 may be configured to have openings with other shapes such as an oval-shaped opening 168 as shown in FIG. 7.

Referring still to FIG. 6, each split-block 60 may include a connector 70 for pivotally or rotatably attaching the split-block 60 to the base member 30 along one or more directions. For example, as shown, the connector 70 may include a threaded rod 72 for insertion into one or more threaded apertures 74 in the first portion 62 of the split-block 60. The connector 70 may also include a spherical ball joint 76 for receiving a positioning rod 78 attached to the base member 30 (shown in FIG. 3).

In use, the threaded rod 72 can be rotated for adjusting orientation of the split-block 60 along a first direction, and the spherical ball joint 76 can be rotated for adjusting orientation of the split-block 60 along a second direction. Reorienting the split-block 60 in one or more directions can be particularly helpful when securing the removable leg rest 140 to different types of wheelchairs, which may have different arrangements of frame members with various shapes, sizes, and orientations.

Figure 9:
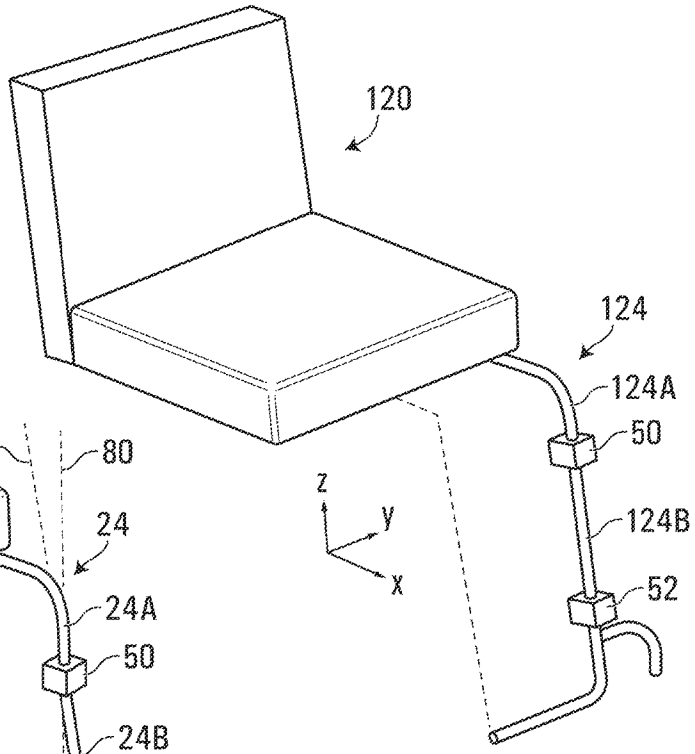
FIG. 9 is a perspective view of the split-block clips being attached to a second wheelchair.
Figure 8:
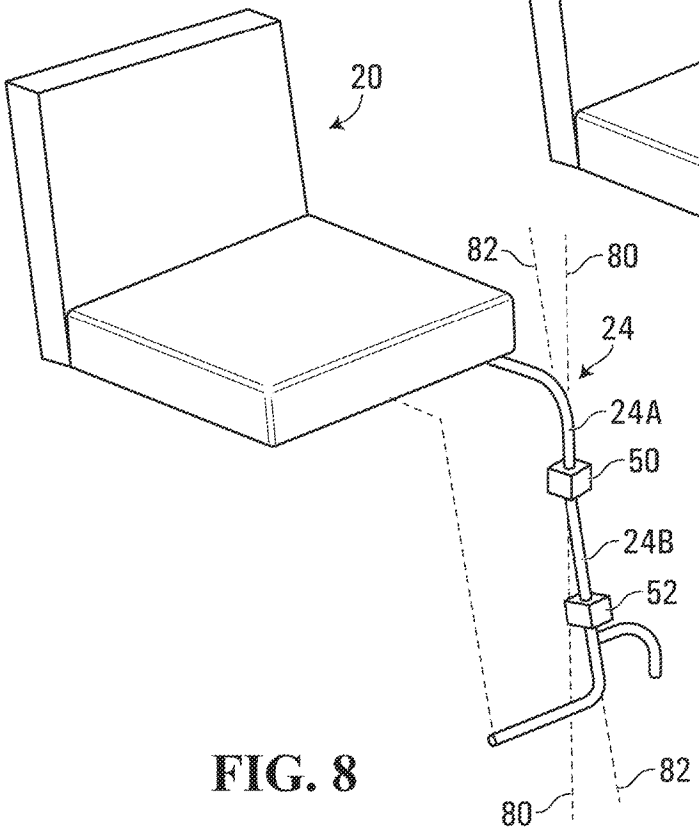
FIG. 8 is a perspective view of the split-block clips being attached to a first wheelchair.

For example, with reference to FIGS. 8 and 9, the clips 50, 52 can be reoriented for use on two different wheelchairs 20, 120. The first wheelchair 20 has a front left frame member 24 with an upper portion 24A that bends inwards and a lower portion 24B that is generally straight. Accordingly, the upper clip 50 engages the upper portion 24A along a first axis 80, and the lower clip 52 engages the lower portion 24B along a second axis 82 that is transverse to the first axis 80. In contrast, the second wheelchair 120 has a front left frame member 24 that is generally straight between both the upper and lower portions 124A, 124B. In either case, reorienting the clips 50, 52 using the connectors 70 can enable attachment to the different wheelchairs.

In some embodiments, the clips 50, 52 may be adjustably coupled to the base member 30 for adjusting relative distance therebetween. For example, the base member 30 may include a positioning rod 78, and the lower clip 52 may be moveably attached to the positioning rod 78 for adjusting the relative distance between the upper clip 50 and the lower clip 52. The positioning rod 78 may have threads that can be inserted into a corresponding threaded aperture on spherical ball joint 76 of the lower clip 52. Screwing the positioning rod 78 into or away from the spherical ball joint 76 can adjust the distance between the clips 50, 52, which can also help enable attachment to different types of wheelchairs.

While the clips 50, 52 of the illustrated embodiment include split-blocks 60, in other embodiments the clips may have other configurations. For example, as shown in FIG. 10, there is a removable leg rest 210 that includes two C-shaped clips 250 (only one is shown in FIG. 10). The C-shaped clips 250 engage the top faces of the front wheelchair frame members 224. The removable leg rest 210 also includes a cross-bar 254 that extends between the C-shaped clips 250 and under the wheelchair frame 222. The cross-bar 254 may be mounted to the wheelchair frame 22 using another clip (not shown). Together, the C-shaped clips 250 and the cross-bar 254 can help secure the leg rest 210 to the wheelchair frame 222.

In other embodiments, the C-shaped clips 250 could engage other portions of the wheelchair frame 222. For example, a first C-shaped clip could engage the top face of an upper portion of the front frame member 224, a second C-shaped clip could engage a front face of the upper portion of the front frame member 224, and a third C-shaped clip could engage the rear face of a lower portion of the front frame member 224. This configuration would enable attachment of the leg rest 210 to one side of the wheelchair using three C-clips and without the cross-bar 254. In general, attachment to one side of the wheelchair can make it easier for users to attach and detach the removable leg rest from their wheelchair (e.g. because only one leg needs to be moved out of the way during attachment or detachment). This can be particularly useful when the user is attaching or removing the leg rest 210 on their own without help from someone else.

In either of the embodiments described above, the C-shaped clips 250 may have resiliently deflectable arms for engaging the cross-sectional portion of the wheelchair frame member. This may enable the C-shaped clips to deflect while being attached to respective portions of the wheelchair frame 222. The C-shaped clips 250 may be made from thin plastics, metals, or other suitable materials.

Referring again to FIG. 3, in the illustrated embodiment, the actuator 34 is motorized. More particularly, the actuator 34 may be an angular adjustment actuator similar to those used in automotive seat recliners. These types of mechanisms are compact and can resist large loads that might be applied to the leg rest 10 during normal operation.

The actuator 34 may include a stationary flange 90 coupled to the base member 30, a mobile flange 92 coupled to the leg support member 32, and a motor 94 for pivoting the mobile flange 92 relative to the stationary flange 90. The motor 94 could be a 12-volt electric motor with an integral speed reducing gear box, which may be similar to those used in automotive seat recliners.

The actuator 34 may also include a battery 96 for powering the motor 94. The battery 96 could be a lithium ion battery or another type of battery such as a lead-acid battery. The battery 96 may be removably attached to a battery mount 97 that is affixed to the base member 30. The battery 96 may have high-current sensing circuitry.

The motor 94 may be operated by an angle adjustment switch 98. The switch 98 may be located on top of the battery 96 and may be a rocker-type switch that is spring loaded to a center/neutral position. Pressing the switch 98 forward or backward may activate the motor 94 to raise or lower the leg support member 32. In other embodiments, the angle adjustment switch 98 could also include one or more buttons for operating the motor 94. For example, there may be an "up" button, a "down" button, and a "on/off" button. The "on/off" button may help prevent accidental actuation by a user.

In other embodiments, the actuator 34 may have other configurations. For example, as shown in FIG. 10, the actuator of the leg rest 210 includes a manually operated ratchet mechanism 234.

In some embodiments, the actuator 34 may include a locking device 100 for holding the leg support member in a selected angular position. The locking device 100 may be located between the stationary flange 90 and the mobile flange 92, and may be similar to locking devices used in automotive seat recliners.

In some embodiments, the locking device may be incorporated in the motor 94 using electronics or gears. In some embodiments, the locking device may isolate the motor and gearbox from loads when stationary. In some embodiments, the locking device may include a physical stop such as with the ratchet mechanism 234 shown in FIG. 10.

During use of the leg rest 10, some users may have muscle spasms. These spasms can generate a dynamic impact loads, which can sometime be four-times the normal passive load. The locking device and other portions of the leg rest may be configured to support such loads.

In some embodiments, the actuator 34 may include an adjustable stop for preventing pivotal movement of the leg support member 32 beyond a maximum raised position. As with the locking device, the adjustable stop may be implemented electronically or physically.

In some embodiments, the maximum raised position may correspond to an angle of about 175-degrees. This may help avoid hyper-extension of the leg. In other examples, the maximum raised position could correspond to larger or smaller angles, for example, depending on a particular user's maximum range of motion relative to their knee.

When a patient starts using the removable leg rest, it can be desirable to gradually increase extension of the leg over time. Accordingly, the adjustable stop may be progressively incremented over several weeks or months to avoid over-extension and possible injury.

In some embodiments, the actuator 34 may be configured to pivot the leg support member 32 below the wheelchair 20 to a stored position (e.g. behind an existing footrest 26, which is shown in FIG. 1).

Figure 11:
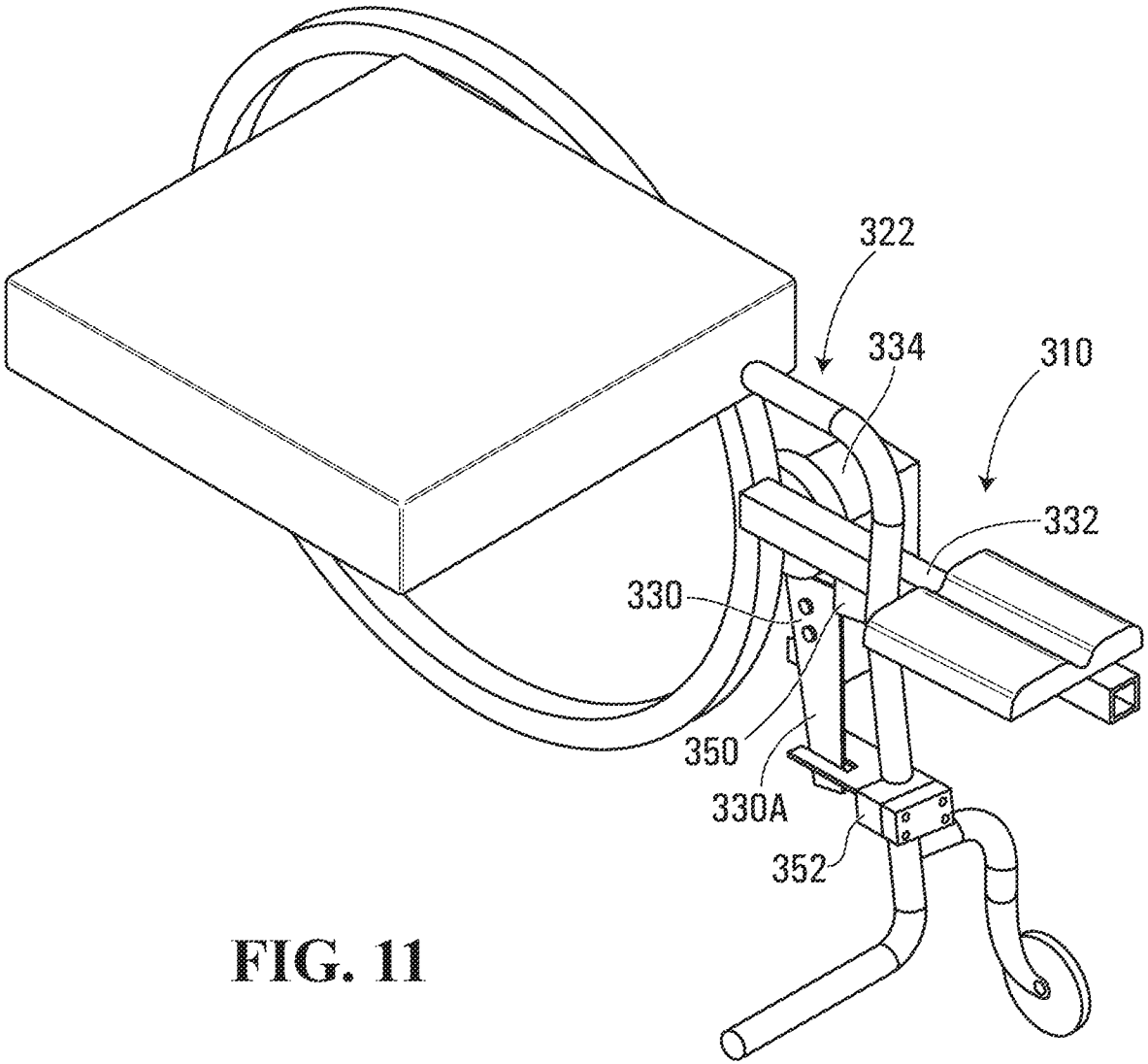
FIG. 11 is a perspective view of another removable leg rest according to another embodiment.

Referring now to FIG. 11, there is a removable leg rest 310 that is similar in some respects to the removable leg rest 10 and similar features are given similar reference numerals incremented by three hundred. For example, the removable leg rest 310 includes a base member 330 configured to be mounted to a wheelchair frame 322, a leg support member 332 pivotally coupled to the base member 330, and an actuator 334 for pivoting the leg support member 332 relative to the base member 330. The removable leg rest 310 also includes upper and lower clips 350, 352 in the form of split-blocks. One difference is that the clips 350, 352 are attached to the base member 330 differently.

Figure 13:
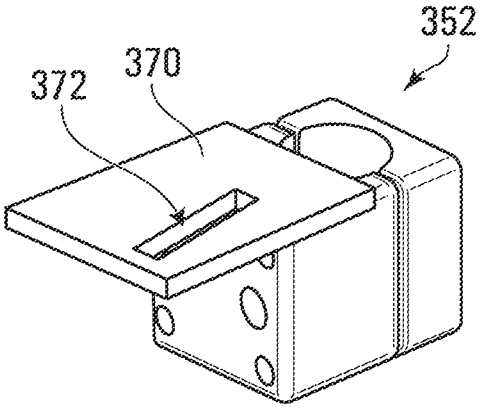
FIG. 13 is a perspective view of a lower clip of the removable leg rest of FIG. 11.
Figure 12:
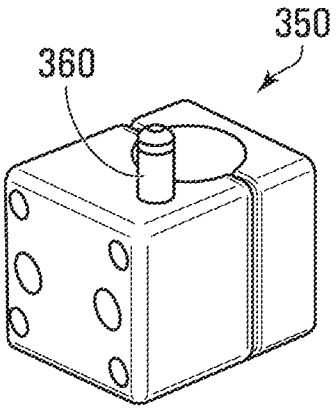
FIG. 12 is a perspective view of an upper clip of the removable leg rest of FIG. 11.

More specifically, as shown in FIGS. 12 and 13, the upper clip 350 has an upwardly extending pin 360 that is shaped to fit within a corresponding aperture on a horizontal portion of the base member 330 (not shown). Furthermore, the lower clip 352 has a mounting sleeve 370 for receiving a portion of the base member 330 therethrough. Specifically, the mounting sleeve 370 has a slot 372 shaped to receive a tapered portion 330A of the base member 330 therethrough (shown in FIG. 11). This allows adjustment of the distance between the upper and lower clips.

This configuration enables attachment and removal of the leg rest 310 by lifting the base member 330 upward off the pin 360 on the upper clip 350, and out of the slot 372 in the lower clip 352. This allows the clips 350, 352 to remain attached to the wheelchair frame 322 even when the leg rest 310 is not in use. For this reason, the two portions of the split-block clips 350, 352 can be attached together using more permanent fasteners such as screws or bolts instead of quick-release fasteners.

Figure 14:
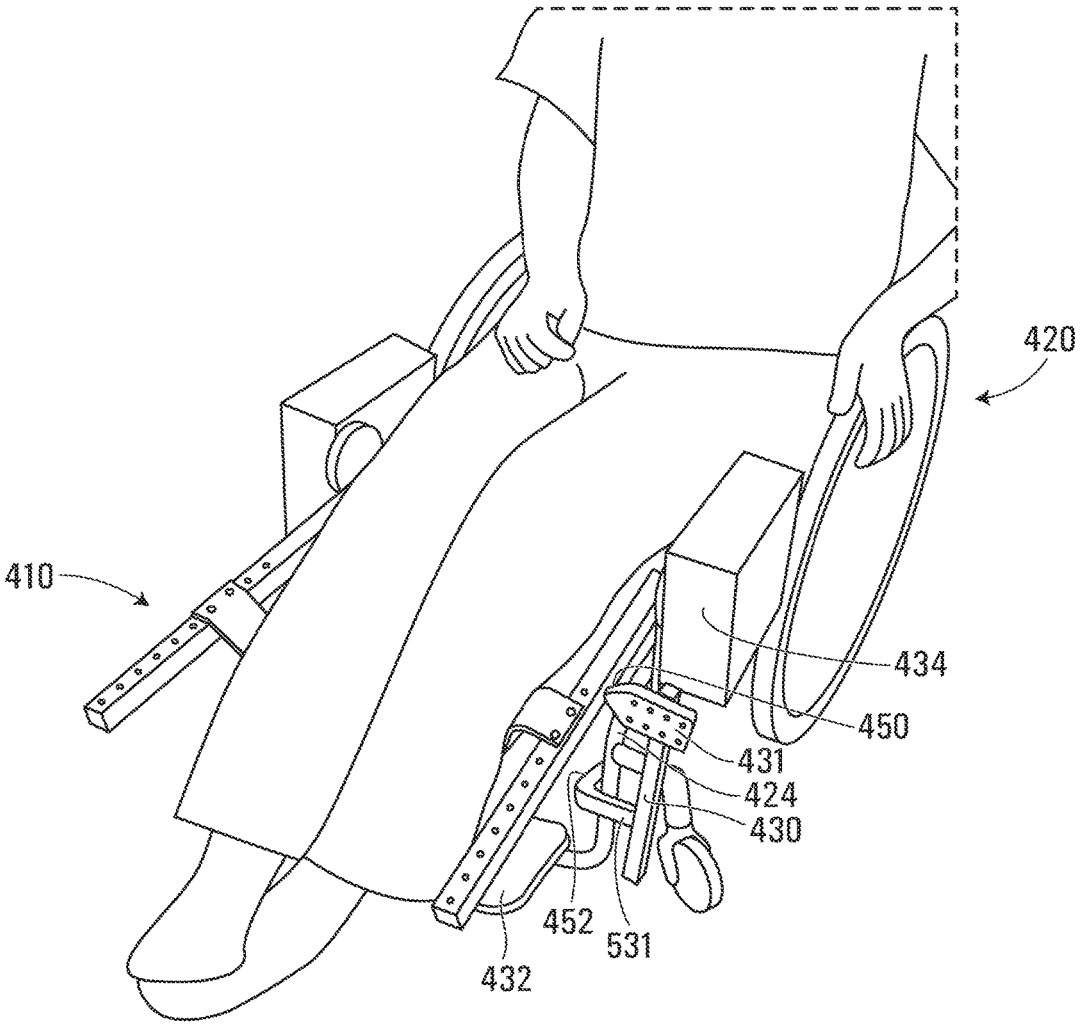
FIG. 14 is a perspective view of a wheelchair with two removable leg rests according to another embodiment.

Referring now to FIG. 14, there is a wheelchair 420 with two removable leg rests 410 according to another embodiment. The leg rests 410 are mounted to left and right sides of the wheelchair 420.

The leg rests 410 are similar in some respects to the removable leg rest 10 and similar features are given similar reference numerals incremented by four hundred. For example, each leg rest 410 includes a base member 430 (also referred to as a "bracket frame member") configured to be mounted to a wheelchair frame 422, a leg support member 432 pivotally coupled to the base member 430, and an actuator 434 for pivoting the leg support member 432 relative to the base member 430. The removable leg rest 410 also includes upper and lower clips 450, 452 for attaching the base member 430 to a wheelchair frame member 424. The clips 450, 452 have an alternative configuration compared to the clips 50, 52.

Figure 15:
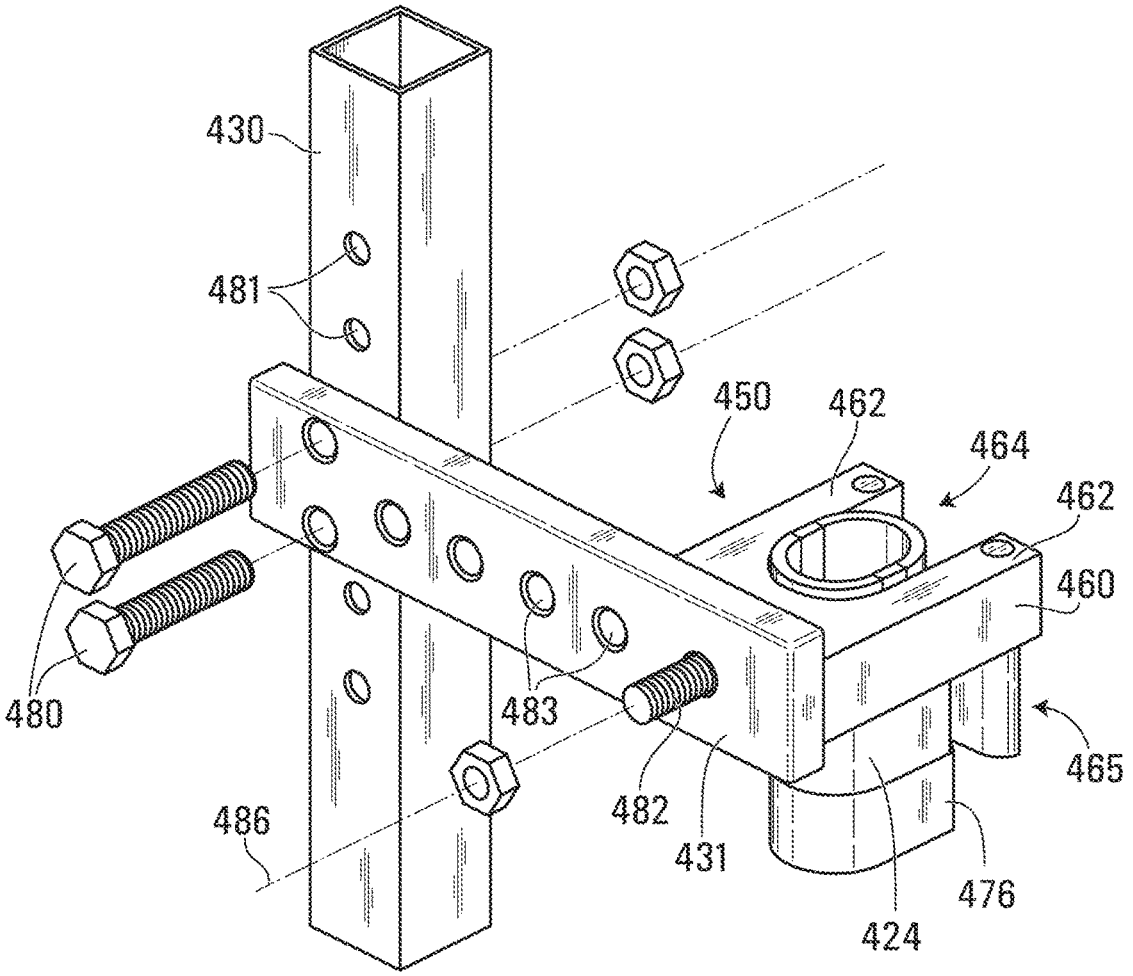
FIG. 15 is a front perspective view of an upper clip of the removable leg rest of FIG. 14.
Figure 16:
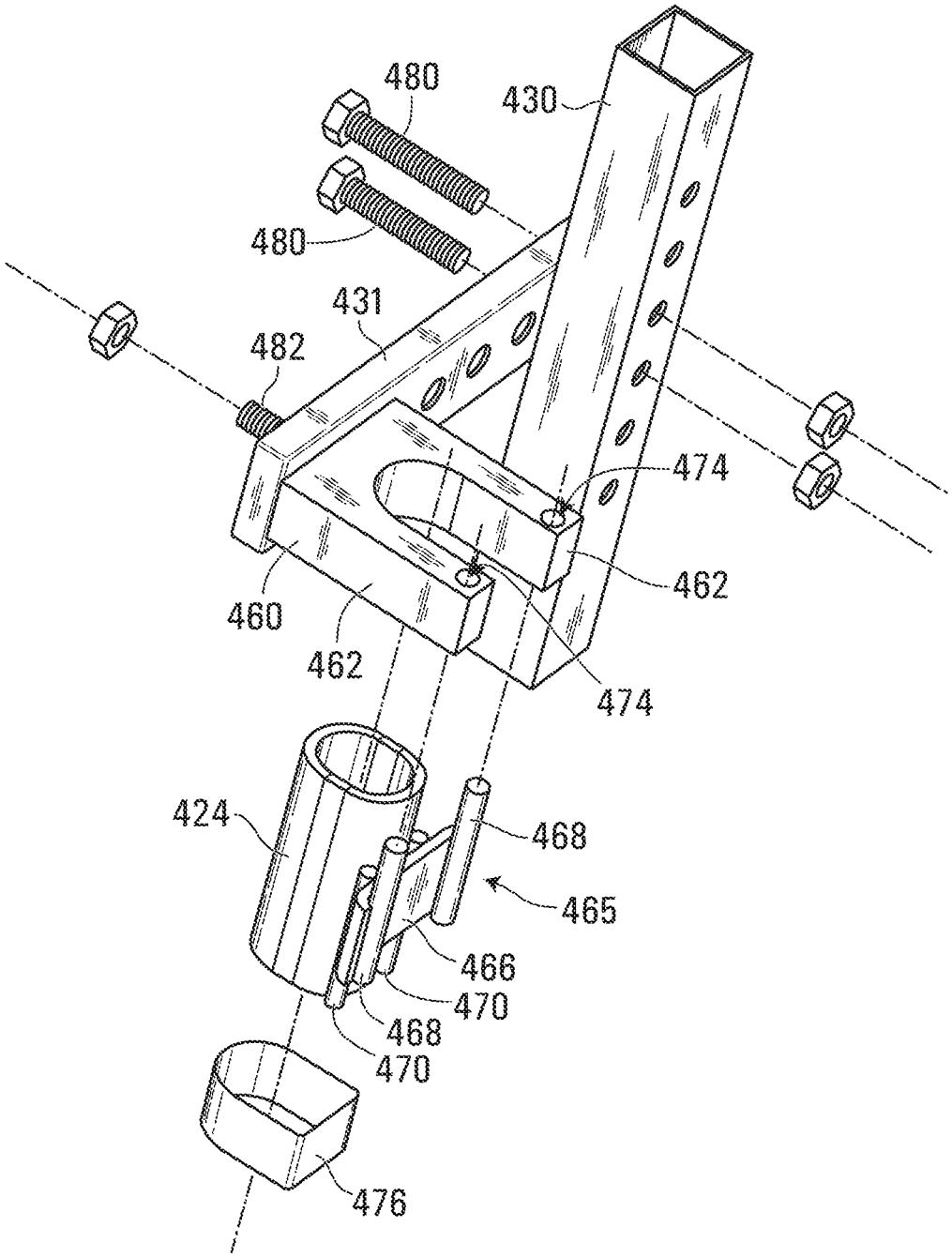
FIG. 16 is a rear exploded perspective view of the upper clip of FIG. 15.

Referring to FIGS. 14-16, the upper clip 450 includes a forked clip member 460 for engaging the wheelchair frame member 424. The forked clip member 460 includes two fingers 462 that are spaced apart to define a grove 464 for receiving the wheelchair frame member 424.

A clip retainer 465 cooperates with the forked clip member 460 to engage the wheelchair frame member 424. In particular, the clip retainer 465 engages a rear cross-sectional portion of the wheelchair frame member 424 while the forked clip member engages a front cross-sectional portion of the wheelchair frame member.

The clip retainer 465 may include a retainer plate 466, two mounting pins 468 on the back of the retainer plate 466, and two retainer legs 470 on the front of the retainer plate 466. The retainer legs 470 are shaped to engage the rear of the wheelchair frame member 424.

The clip retainer 465 may be secured to the wheelchair frame 424 and the forked clip member 460 may be removably attached to the clip retainer 465. This allows the forked clip member 460 to be removed from the wheelchair frame 422 along with the rest of the leg rest 410.

The clip retainer 465 may be secured to the wheelchair frame member 424 using a fastener such as a hose clamp 476. The hose clamp 476 may encircle the retainer legs 470 and the wheelchair frame member 424 and hold them together under tension. In other embodiments, the clip retainer 465 could be secured to the wheelchair frame member 424 using another type of fastener such as a screw, bolt, or adhesive.

The mounting pins 468 allow the leg rest 410 to be attached or removed from the wheelchair 420. As shown, the mounting pins 468 are shaped to fit within two corresponding mounting apertures 474 on the fingers 462 of the forked clip member 460. Accordingly, the leg rest 410 can be attached to the wheelchair frame 422 by lowering the forked clip member 460 so that the mounting pins 468 slide into the mounting apertures 474. Similarly, the leg rest 410 can be removed by lifting the forked clip member 460 upward off the mounting pins 468 for removal. This removable mounting configuration can be helpful when transporting or storing the wheelchair 420.

The upper clip 450 may also have an adjustable position and orientation. For example, the upper clip 450 may be attached to the base member 430 via a bracket arm 431, and the bracket arm 431 may be attached to the base member 430 using one or more bolts 480 that extend through corresponding apertures in the bracket arm 431 and the base member 430. As shown, there may be a series of vertically spaced apertures 481 along the base member 430. This may provide the upper clip 450 with an adjustable vertical position.

Furthermore, the upper clip 450 may be secured to the bracket arm 431 using a pivotal connection. For example, a bolt 482 extends from the forked clip member 460 and through an aperture in the bracket arm 431. The bolt 482 provides a pivotal connection about a pivot axis 486, which can provide the upper clip 450 with an adjustable orientation. Furthermore, as shown, there may be a series of laterally spaced apertures 483 along the bracket arm 431. This may provide the upper clip 450 with an adjustable lateral position.

Providing the upper clip 450 with an adjustable position and orientation can enable the leg rest 410 to be used with a variety of wheelchairs such as the ones shown in FIGS. 8 and 9.

Figure 17:
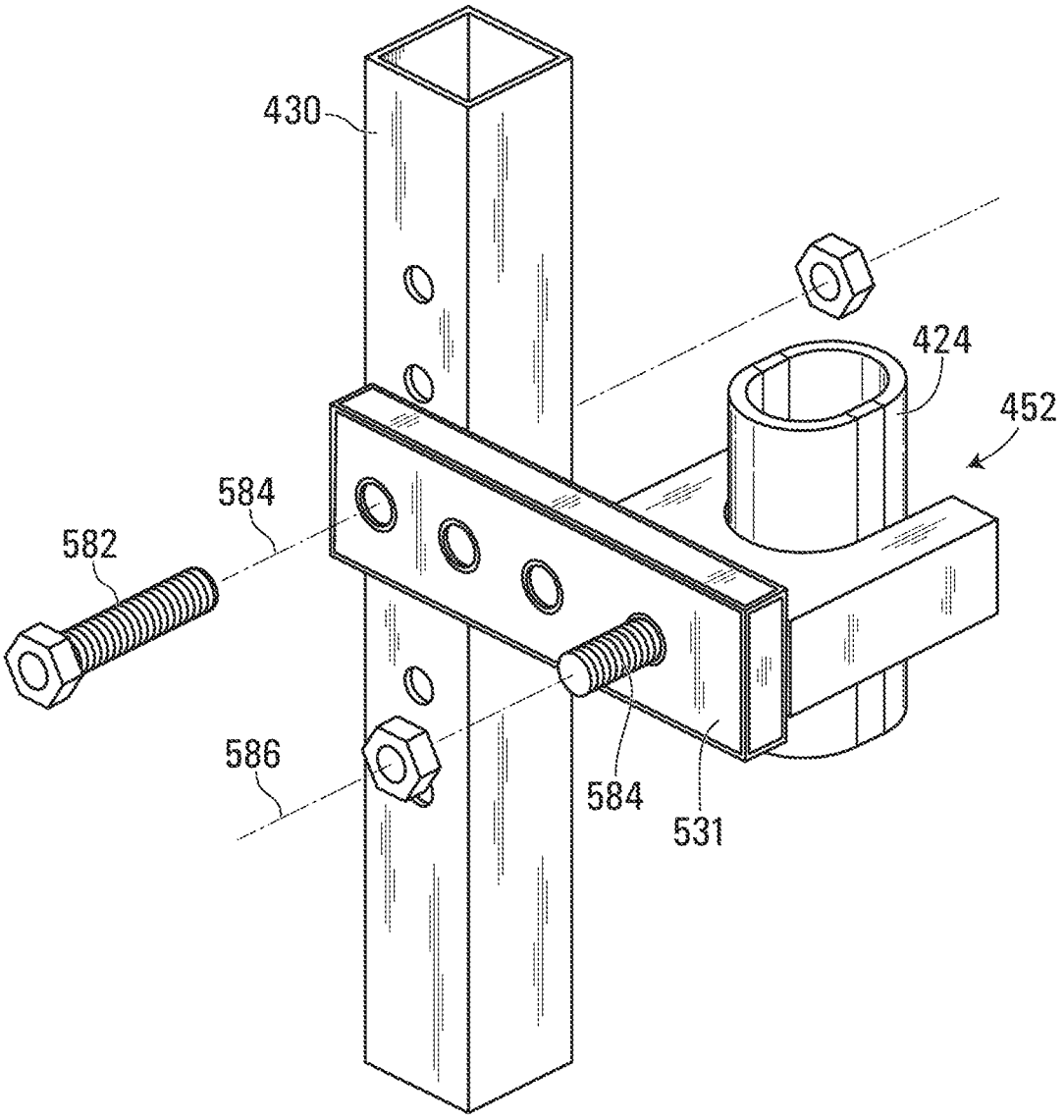
FIG. 17 is a front perspective view of a lower clip of the removable leg rest of FIG. 14.

Referring now to FIGS. 14 and 17, the lower clip 452 is similar in some respects to the upper clip 450. For example, the lower clip includes a forked clip member 560 for engaging the wheelchair frame member 424. The forked clip 560 member is attached to the base member 430 using a bracket arm 531 and connectors such as bolts 582, 584. One difference is that the lower clip 452 does not include a clip retainer.

As shown, the lower clip 452 is configured to engage a front cross-sectional portion of the wheelchair frame member 424 and the rear cross-sectional portion of the wheelchair frame member 424 is left open. With this configuration, the lower clip 452 resists downward pivotal movement of the leg rest 410 about the upper clip 450 (e.g. when a person's leg is resting on the leg support member 432). At the same time, leaving the lower clip 452 open at the rear cross-sectional portion of the wheelchair frame member 424 can enable easier attachment and removal of the leg rest 410.

In other embodiments, the lower clip 452 could engage both the front and rear cross-sectional portions of the wheelchair frame member 424. For example, the lower clip 452 could include a clip retainer 465 similar to the upper clip 450.

Another difference with the lower clip 452 is that the bracket arm 431 is attached to the base member 430 using one bolt 580 instead of two bolts. This configuration provides a first pivot axis 584 about bolt 580, and a second pivot axis 586 about bolt 582. Having two pivotal connections can provide a greater variety of positions and orientations for the lower clip 452. This can be helpful when attaching the leg rest 410 to a variety of different wheelchairs 420.

In general, one or more of the removable leg rests disclosed herein can be easily and quickly retrofitted onto a variety of different wheelchair frames. This can save the user from purchasing a specialized wheelchair to address muscle contractures.

Furthermore, one or more of the removable leg rests described herein can enable a user to independently elevate their lower leg through a particular range of motion such as between a fully flexed position and a fully extended position (e.g. from about 85° to about 175°). This can help reduce, prevent, or reverse muscle contractures.

In some embodiments, the angular position of the leg rest may be progressively incremented. For example, the leg support member may be progressively raised in increments of 1-degree to 5-degrees. The increments could be spaced out over certain periods of time such as an increment every one to four weeks. For example, the leg support member may be raised in 2-degree increments every three weeks. This may be continued for several weeks or months, or until a patient recovers a desired range of motion.

While the embodiments herein refer to reducing, preventing, or reversing muscle contractor, the removable leg rest may also be helpful in other ways. For example, the removable leg rest may reduce edema or swelling. The removable leg rest may help treat spasticity such as lower limb spasticity. The removable leg rest may improve quality of life, and may promote functional independence.

Some test results have indicated that users have reduced spasms and reduced lower limb edema after one week of using the leg rest. In some cases, users have reported that spasms are no longer waking them up during the night.

While the above description provides examples of one or more apparatus, methods, or systems, it will be appreciated that other apparatus, methods, or systems may be within the scope of the following claims as interpreted by one of skill in the art.

The invention claimed is:

1. A removable leg rest for a wheelchair, the removable leg rest comprising:

a) a base member configured to be mounted to a wheelchair frame having a wheelchair frame member;

b) a leg support member pivotally coupled to the base member;

c) an actuator for pivoting the leg support member relative to the base member between a lowered position and a raised position; and d) a plurality of mounting clips for attaching the base member to the wheelchair frame member, the mounting clips each being configured to releasably engage a cross-sectional portion of the wheelchair frame member, and each clip including a connector for pivotally attaching the clip to the base member, the plurality of mounting clips include at least:

i) a first clip configured to engage a first cross-sectional portion of the wheelchair frame member; and ii) a second clip configured to engage a second cross-sectional portion of the wheelchair frame member, the second clip is adjustably coupled to the base member for adjusting relative distance between the first clip and the second clip.

2. The removable leg rest of claim 1, wherein the mounting clips are configured to circumscribe the cross-sectional portion of the wheelchair frame member.

3. The removable leg rest of claim 1, wherein the actuator includes a locking device for holding the leg support member in a selected angular position.

4. The removable leg rest of claim 1, wherein the actuator includes a stop for preventing pivotal movement of the leg support member beyond a maximum raised position.

5. The removable leg rest of claim 1, wherein the first clip is configured to engage the first cross-sectional portion of the wheelchair frame member along a first axis, and wherein the second clip is configured to engage the second cross-sectional portion of the wheelchair frame along a second axis that is transverse to the first axis.

6. The removable leg rest of claim 1, wherein the base member includes a positioning rod, and wherein the second clip is moveably attached to the positioning rod for adjusting the relative distance between the first clip and the second clip.

7. The removable leg rest of claim 1, wherein the mounting clips are a split-block for clamping onto the cross-sectional portion of the wheelchair frame member, the split-block including a first portion coupled to the base member, a second portion separable from the first portion, and a fastener for securing the first portion to the second portion and clamping the cross-sectional portion of the wheelchair frame member therebetween.

8. The removable leg rest of claim 1, wherein the actuator is motorized.

9. The removable leg rest of claim 8, wherein the actuator includes:

a) a stationary flange coupled to the base member;
b) a mobile flange coupled to the leg support member; and
c) a motor for pivoting the mobile flange relative to the stationary flange.

10. The removable leg rest of claim 9, wherein the actuator includes a battery for powering the motor.

11. The removable leg rest of claim 9, wherein the actuator includes an angle adjustment switch.

12. The removable leg rest of claim 11, wherein the angle adjustment switch is a rocker-type switch that is spring loaded to a neutral position.

13. A removable leg rest for a wheelchair, the removable leg rest comprising:
a) a base member configured to be mounted to a wheelchair frame having a wheelchair frame member;
b) a leg support member pivotally coupled to the base member;
c) an actuator for pivoting the leg support member relative to the base member between a lowered position and a raised position; and
d) a mounting clip for attaching the base member to the wheelchair frame member, the mounting clip being configured to releasably engage a cross-sectional portion of the wheelchair frame member, the mounting clip is a split-block for clamping onto the cross-sectional portion of the wheelchair frame member, the split-block including a first portion coupled to the base member, a second portion separable from the first portion, and a fastener for securing the first portion to the second portion and clamping the cross-sectional portion of the wheelchair frame member therebetween.

14. The removable leg rest of claim 13, wherein the mounting clip is configured to circumscribe the cross-sectional portion of the wheelchair frame member.

15. The removable let rest of claim 13, wherein the mounting clip includes a plurality of clips.

16. The removable leg rest of claim 15, wherein the mounting clips include:
a) a first clip configured to engage a first cross-sectional portion of the wheelchair frame member; and
b) a second clip configured to engage a second cross-sectional portion of the wheelchair frame member.

17. The removable leg rest of claim 16, wherein the first clip is configured to engage the first cross-sectional portion of the wheelchair frame member along a first axis, and wherein the second clip is configured to engage the second cross-sectional portion of the wheelchair frame along a second axis that is transverse to the first axis.

18. The removable let rest of claim 17, wherein each clip includes a connector for pivotally attaching the clip to the base member.

19. The removable leg rest of claim 16, wherein the second clip is adjustably coupled to the base member for adjusting relative distance between the first clip and the second clip.

20. The removable leg rest of claim 19, wherein the base member includes a positioning rod, and wherein the second clip is moveably attached to the positioning rod for adjusting the relative distance between the first clip and the second clip.

21. The removable leg rest of claim 13, wherein the actuator is motorized.

22. The removable leg rest of claim 21, wherein the actuator includes:
a) a stationary flange coupled to the base member;
b) a mobile flange coupled to the leg support member; and
c) a motor for pivoting the mobile flange relative to the stationary flange.

23. The removable leg rest of claim 22, wherein the actuator includes a battery for powering the motor.

24. The removable leg rest of claim 22, wherein the actuator includes an angle adjustment switch.

25. The removable leg rest of claim 24, wherein the angle adjustment switch is a rocker-type switch that is spring loaded to a neutral position.

26. The removable leg rest of claim 13, wherein the actuator includes a locking device for holding the leg support member in a selected angular position.

27. The removable leg rest of claim 13, wherein the actuator includes a stop for preventing pivotal movement of the leg support member beyond a maximum raised position.

* * * * *